US005523130A

United States Patent [19]

Sullivan

[11] Patent Number: 5,523,130

[45] Date of Patent: Jun. 4, 1996

[54] CHRISTMAS TREE DECORATION HANGING SYSTEM

[75] Inventor: Kimberly M. Sullivan, La Jolla, Calif.

[73] Assignee: Halo Products Inc., San Diego, Calif.

[21] Appl. No.: 361,293

[22] Filed: Dec. 22, 1994

[51] Int. Cl.[6] ..... A47G 33/06

[52] U.S. Cl. ..... 428/19; 428/20

[58] Field of Search ..... 428/7, 18, 19, 428/20

[56] References Cited

U.S. PATENT DOCUMENTS

| | | | |
|---|---|---|---|
| 710,095 | 9/1902 | Buffum | 223/106 |
| 867,583 | 10/1907 | Lee | 223/106 |
| 872,296 | 11/1907 | Hoskins | 223/106 |
| 1,241,522 | 10/1917 | Kellner | 223/106 |
| 1,327,581 | 1/1920 | Yeats | 223/106 |
| 2,714,776 | 8/1955 | Lee | 428/7 X R |
| 3,676,275 | 7/1972 | Sloane | 428/19 X R |
| 3,723,723 | 3/1973 | Lerner | 428/18 X R |
| 4,145,731 | 3/1979 | Adamich | 428/9 X R |
| 5,094,893 | 3/1992 | Snider | 428/18 |

*Primary Examiner*—Henry F. Epstein
*Attorney, Agent, or Firm*—John R. Flanagan

[57] ABSTRACT

A tree decorating system has a hanger device for a plurality of hanger elements which may be used for attachment to a plurality of elongated decorations. The hanger device has a plurality of hook elements spaced circumferentially from one another about an exterior side of a rigid annular body of the hanger device. Gripping elements with radial slots for tree branches extend inward from an interior side of the rigid annular body and form a central opening through which the top portion of a main stem of the tree stem may pass. The hanger elements have living hinges enabling formation of a respective pair of flaps thereon to move between open and closed positions relative to one another. The pairs of flaps have sets of complementary ribs thereon enabling the fastening of the flaps at the closed position and clamping of an end portion of an elongated decoration therebetween. The flaps of each hanger element have apertures formed therethrough which are aligned with one another in the closed position providing means for hanging the hanger element attached to an elongated decoration over one of the hook elements of the hanger device.

20 Claims, 1 Drawing Sheet

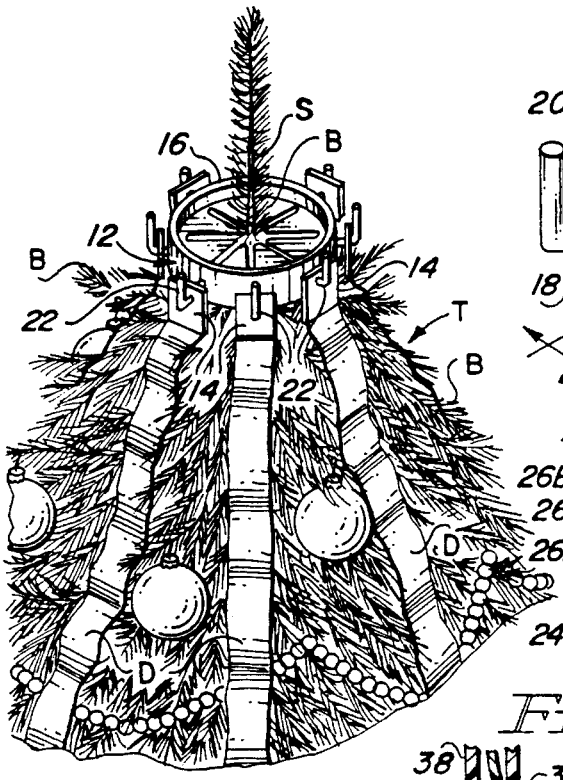
FIG. 1
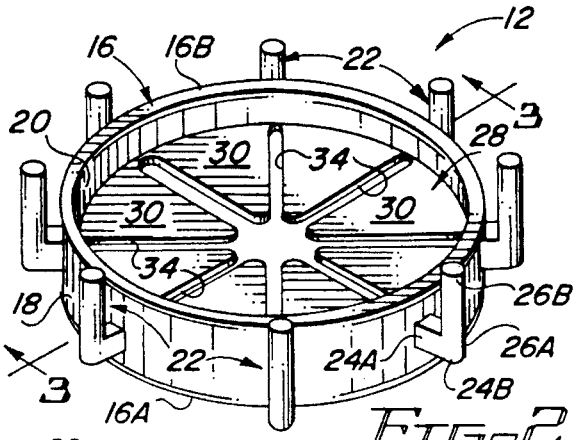
FIG. 2
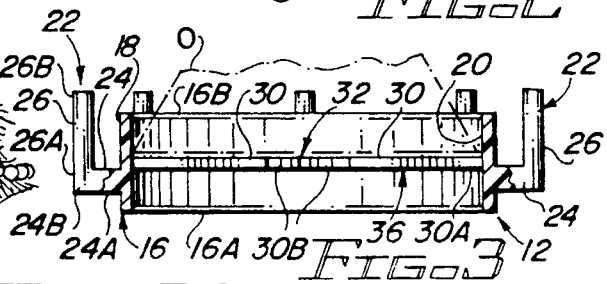
FIG. 3
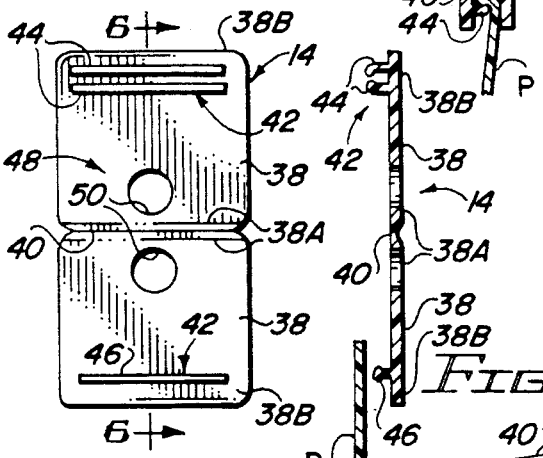
FIG. 6A
FIG. 5
FIG. 6
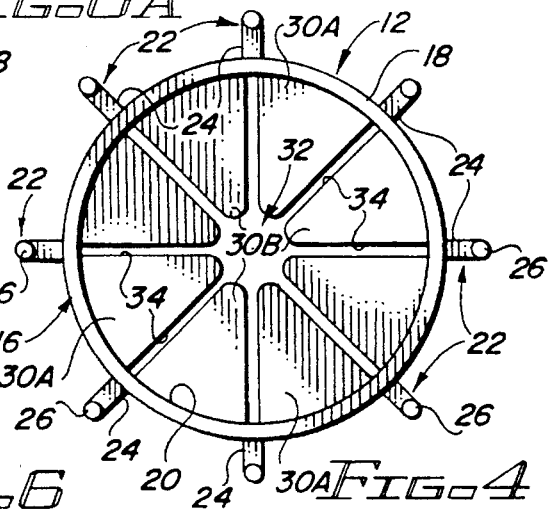
FIG. 4
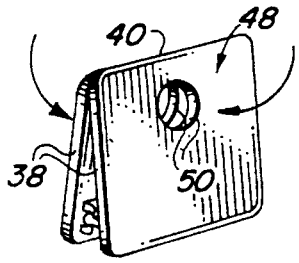
FIG. 7
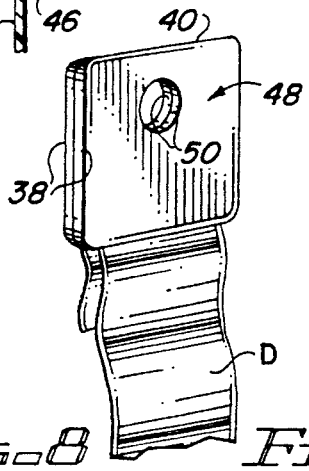
FIG. 8
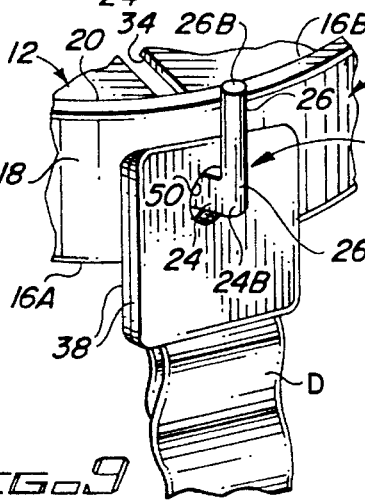
FIG. 9

CHRISTMAS TREE DECORATION HANGING SYSTEM

BACKGROUND OF THE INVENTION

1. Field of the Invention

The present invention generally relates to Christmas tree decorating systems and, more particularly, is concerned with a tree decoration hanging system employing a tree top-mounted hanger device with hanger elements supporting elongated decorations from the hanger device.

2. Description of the Prior Art

The decoration of Christmas trees is an integral part of the holiday season and is widely practiced. For some people this is an enjoyable event, while for others this can be a time-consuming and tedious task.

Placing objects on or hanging objects from Christmas tree branches has been the standard method of decoration. A problem often exists in that tree branches can be oddly shaped and asymmetrical. Thus, orderly decorating of such trees can be difficult. In addition, the odd shapes and instability of branches limit the types of ornaments and decorations that can be used on them.

Structural additions to both natural and artificial Christmas trees have addressed this problem to a limited extent. A tinsel package disclosed in U.S. Pat. No. 2,714,776 to Lee attempts to hang tinsel strips in a way so as to make the entire tree appear uniformly shaped. This package provides an annular spacer element with strips of tinsel wrapped and folded upon themselves over the spacer element and then about a supporting core. However, a drawback is the fragility of the package and the tendency thereof towards a state of disarray unwrapping and rewrapping of many pieces resulting in a time-consuming and tedious task.

The tree covering disclosed in U.S. Pat. No. 3,676,275 to Sloane is limited to artificial trees and is complex by nature. The covering involves a tent-like draping of a tree or similar structure with a complex web network that supports a tinsel garland. A central ring is used for placement over the top or main stem of the tree. Hooks affixed to longitudinal backing strips engage the ring to support the draping system. This method, however, uses a pre-designed pattern, which lacks decorative variety and flexibility.

An electric light decoration set disclosed in U.S. Pat. No. 3,723,723 to Lerner involves a permanent arrangement of miniature lamps strung in parallel circuit down from an insulated casing at the top of a Christmas tree, but is limited to the specific use of electric lights and does not have a fastening system at the top of the tree that would permit a variety of decorations to be hung.

The artificial Christmas tree disclosed in U.S. Pat. No. 5,094,893 to Snider involves a stable but rather complex arrangement simulating a real Christmas tree. A circular platform at the top of the simulated tree has a central sleeve and a plurality of posts mounted upright upon the periphery of the platform's top surface that receive the looped ends of cords or cables which extend downward to a spoked hoop creating the basic framework for the tree. This device, however, is limited to the artificial tree situation. The top platform with its central sleeve and posts would also be difficult to adapt for use on a natural tree and would fail to provide ample room for the attachment or setting of decorations on the platform surface.

While these prior devices may have advantages in their specific applications, they do not seem to provide a comprehensive solution for Christmas tree decoration. Consequently, a need still exists for a tree decorating system that is simple, efficient and permits a variety of uses with general application.

SUMMARY OF THE INVENTION

The present invention provides a tree decoration hanging system designed to satisfy the aforementioned needs. This system which has a hanger device adapted to support a plurality of hanger elements for attaching and suspending elongated decorations therefrom is neither limited to artificial nor natural trees nor to any particular kind of decoration. Instead, hanger device can be placed at the top of either type of tree and has a plurality of hook elements to support the hanger elements for attachment to any number of possible elongated decorations, including lengths of ribbon or tinsel. The hanger device, with a central opening for receiving a tree stem and radial slots for tree branches, may also serve as a platform upon which ornaments may be rested at the top of the tree. In summary, the decoration hanging system of the present invention is simple and efficient, may support a variety of elongated decorations, and provides for general application to all kinds of trees.

Accordingly, the present invention relates to a tree decoration hanging system, which comprises: (a) a hanger device including (i) an annular body having exterior and interior sides, (ii) a plurality of support elements mounted to and spaced about the exterior side of the annular body, each of the support elements extending radially outward therefrom, and (iii) means mounted about the interior side of the annular body and extending radially inward therefrom so as to define a central opening for receiving a top portion of a main stem of a tree therethrough; and (b) a plurality of hanger elements each attachable to one decoration of a plurality of elongated decorations and receivable on one of the support elements of the hanger device.

The present invention also relates to the hanger device as defined above and to each of the plurality of hanger elements. Each hanger element comprises: (a) a pair of flaps; (b) means for hinging the flaps to one another to undergo movement between open and closed positions; (c) means for fastening the flaps to one another at the closed position and for clamping one end portion of a respective one of the elongated decorations between the flaps at the closed position; and (d) means for hanging the flaps in the closed position to support the hanger element and the elongated decoration therefrom.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of the decoration hanging system of the present invention shown deployed on a Christmas tree.

FIG. 2 is an enlarged perspective view of a hanger device of the decoration hanging system of FIG. 1.

FIG. 3 is a cross-sectional view of the hanger device taken along line 3—3 of FIG. 2.

FIG. 4 is a top view of the hanger device of FIG. 2.

FIG. 5 is plan view of one of a plurality of hanger elements of the decoration hanging system of FIG. 1, the hanger element being shown in an unfolded condition.

FIGS. 6 and 6A are cross-sectional views of the hanger element taken along line 6—6 of FIG. 5, showing hanger element in respective open and closed conditions.

FIG. 7 is a perspective view of the hanger element in a folded but open condition.

FIG. 8 is a perspective view of the hanger element in a folded and closed condition, clamping one end of an elongated decoration between opposing halves of the hanger element.

FIG. 9 is a perspective view of a fragmentary portion of the hanger device with one of a plurality of hook elements thereon supporting a hanger element attached to an end portion of an elongated decoration.

DETAILED DESCRIPTION OF THE INVENTION

Referring now to the drawings and particularly to FIGS. 1, 2 and 9, there is illustrated a decoration hanging system of the present invention, generally designated 10, deployed on a Christmas tree T. Basically, the system 10 includes a hanger device 12 and a plurality of hanger elements 14.

Referring to FIGS. 1–4 and 9, the hanger device 12 of the system 10 includes a rigid annular body 16 having a ring-shaped structure and opposite exterior and interior sides 18, 20, and a plurality of supports 22 in the form of hook elements 22 mounted to the annular body 16 and spaced about the exterior side 18 of the annular body 16. The hook elements 22 are spaced circumferentially from one another and extend radially outward from the exterior side 18 of the annular body 16. Each hook element 22 has a radial spoke portion 24 fixed at an inner end 24A to the exterior side 18 of the annular body 16 and extends radially outward therefrom, and an upright support portion 26 fixed at a lower end 26A to an outer end 24B of the radial spoke portion 24 and extends transversely to and upward from the radial spoke portion 24. The radial spoke portions 24 of the hook elements 22 are attached on the exterior side 18 of the annular body 16 closer to the bottom edge 16A than the top edge 16B thereof. The upright support portions 26 of the hook elements 22 terminate at upper ends 26B located above the top edge 16B of the annular body 16.

The hanger device 12 of the system 10 also includes means 28 mounted about the interior side 20 of the annular body 16 and extending radially inward therefrom for receiving a top portion of a main stem S of the tree T therethrough. The receiving means 28 takes the form of a plurality of pie-shaped blade-like gripping elements 30 mounted to and spaced about the interior side 20 of the annular body 16. The gripping elements 30 are fixed at their outer edges 30A to the interior side 20 of the annular body 16 approximately midway between the bottom and top edges 16A, 16B thereof. The gripping elements 30 extend radially inward toward one another and terminate at inner edges 30B being disposed in spaced relation from one another so as to define a central opening 32. The gripping elements 30 are spaced apart so as to define radial slots 34 that extend therebetween from the central opening 32 outward to the interior side 20 of the annular body 16. The radial slots 34 provide spaces between the gripping elements 30 for passage upward of branches B extending from the top portion of the main stem S of the tree T extending through the central opening 32 of the annular body 16. As seen in FIG. 1, the platform 36 of the hanger device 12 rests on those of the branches B of the T located immediately below the hanger device 12.

The gripping elements 30 are relatively flat so as to extend coplanarly with respect to one another and thereby provide a platform 36 surrounded by the upper portion of the annular body 16. With the hanger device 12 placed at the top of the tree T, the platform 36 defined by the gripping elements 30 serves to support an ornamental decoration 0 on the top of the tree T.

Referring to FIGS. 1 and 5–9, each of the hanger elements 14 of the system 10 has a pair of flat flaps 38 and means in the form of a living hinge 40 interconnecting inner edges 38A of the flaps 38, enabling the flaps 38 to undergo movement away from and toward one another between an open position, as shown in FIG. 5, and a closed position, as shown in FIGS. 8 and 9. Each hanger element 14 also includes means 42 for fastening the flaps 38 to one another at the closed position and for clamping an end portion P of a respective one of a plurality of elongated decorations D, such as strips of ribbon, between the flaps 38 at the closed position. The fastening and clamping means 42 takes the form of a set of complementary ribs 44, 46 defined on and projecting outward from facing surfaces of the flaps 38. The ribs 44, 46 are spaced opposite from one another and adjacent to outer edges 38B of the flaps 38 so that they will engage when the flaps 38 are folded to the closed position. As shown in FIG. 6A, the pair of ribs 44 are adapted to snap fit over the single rib 46 and clamp therebetween the end portion P of the elongated decoration D upon moving the flaps 38 to the closed position.

Also, as seen in FIGS. 5 and 7–9, each hanger element 14 includes means 48 for hanging the fastened flaps 38 of the hanger element 14 over a respective one of the hanger elements 14 in order to hang the elongated decoration D from the hanger device 12. The hanging means 48 has a pair of apertures 50 each defined in one of the flaps 38 and aligned with one another, as seen in FIGS. 7–9, when the flaps 38 are moved to the closed position.

The color of the hanger device 12 and hanger elements 14 of the decoration hanging system 10 can be selected to match the color of the tree branches B so as to camouflage the system 10 and thereby give the appearance that the elongated decorations are hanging from the tree branches B. The opening and closing feature of the hanger elements 14 permit the particular decorations to be replaced when desired.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A tree decoration hanging system, comprising:

(a) a hanger device including (i) an annular ring-shaped body having exterior and interior sides, (ii) a plurality of support elements mounted to and spaced circumferentially from one another about said exterior side of said annular body, each of said support elements extending radially outward therefrom, said plurality of support elements being a plurality of hook elements each separate from one another and having a first portion mounted to said exterior side of said annular body and extending radially outwardly therefrom and a second portion extending transversely to said first portion, and (iii) means mounted about said interior side of said annular body and extending radially inward therefrom for receiving a top portion of a main stem of a Christmas tree therethrough; and (b) a plurality of hanger elements each attachable to one decoration of a plurality of elongated decorations and receivable on one of said support elements of the hanger device.

2. The system of claim 1 wherein each of said hanger elements contains an aperture therein for insertion of said hanger element over one of said hook elements.

3. The system of claim 1 wherein:

said first portion of each of said hook elements is a radial spoke portion fixed at an inner end to said exterior side of said annular body and extending radially outward therefrom; and said second portion of each of said hook elements is an upright support portion fixed at a lower end to an outer end of said radial spoke portion and extending upwardly from said radial spoke portion.

4. The system of claim 1 wherein said receiving means is a plurality of gripping elements mounted to and spaced apart from one another about said interior side of said annular body and extending radially inward therefrom toward one another, said gripping elements terminating at inner edges disposed in spaced relation from one another so as to define a central opening for receiving the top portion of the main stem of the Christmas tree therethrough.

5. The system of claim 4 wherein said plurality of gripping elements are fixed at their outer edges to said interior side of said annular body and extend radially inward toward one another to said inner edges thereof defining said central opening therebetween and extend coplanarly with respect to one another so as to provide a platform upon which to rest an ornament.

6. The system of claim 4 wherein said plurality of gripping elements define radial slots extending therebetween from said central opening outward to said interior surface of said annular body to provide spaces between said gripping elements.

7. The system of claim 1 wherein each of said hanger elements has means for attaching to one end portion of a respective one of the elongated decorations so as to permit the hanging of the elongated decorations from said hanger device.

8. The system of claim 1 wherein each of said hanger elements is a flat plate having a central living hinge portion so as to permit said hanger element to fold onto itself and to enclose the one end portion of the respective one of the elongated decorations.

9. The system of claim 8 wherein each of said hanger elements has means for attaching to one end portion of a respective one of said elongated decorations so as to permit the hanging of the elongated decorations from the hanger device, said attaching means being complementary sets of ribs defined on said flat plate and being spaced opposite one another adjacent to opposite edge portions of said flat plate and adapted to snap fit together upon folding said flat plate at said living hinge portion thereof and upon itself.

10. The system of claim 1 wherein said hanger device and hanger elements are of a color matching the color of the tree so as to camouflage said system and give the appearance that the elongated decorations are hanging from branches of the tree.

11. A hanger device for a tree decoration hanging system, said device comprising:

(a) an annular ring-shaped body having exterior and interior sides;

(b) a plurality of support elements mounted to and spaced circumferentially from one another about said exterior side of said annular body, each of said support elements extending radially outward therefrom, said plurality of support elements being a plurality of hook elements each separate from one another and having a first portion mounted to said exterior side of said annular body and extending radially outwardly therefrom and a second portion extending upwardly from said first portion; and (c) means mounted about said interior side of said annular body and extending radially inward therefrom for receiving a top portion of a main stem of a tree therethrough.

12. The system of claim 11 wherein:

said first portion of each of said hook elements is a radial spoke portion fixed at an inner end to said exterior side of said annular body and extending radially outward therefrom; and said second portion of each of said hook elements is an upright support portion fixed at a lower end to an outer end of said radial spoke portion and extending upwardly from said radial spoke portion.

13. A hanger device for a tree decoration hanging system, said device comprising:

(a) an annular ring-shaped body having exterior and interior sides;

(b) a plurality of support elements mounted to and spaced about said exterior side of said annular body, each of said support elements extending radially outward therefrom; and (c) means mounted about said interior side of said annular body and extending radially inward therefrom for receiving and gripping a top portion of a main stem of a Christmas tree therethrough, said receiving means being a plurality of gripping elements mounted to and spaced apart from one another about said interior side of said annular body and extending radially inward therefrom toward one another, said gripping elements terminating at inner edges disposed in spaced relation from one another so as to define a central opening for receiving the top portion of the main stem of the Christmas tree therethrough.

14. The device of claim 13 wherein said plurality of gripping elements are fixed at their outer edges to said interior side of said annular body and extend radially inward toward one another to said inner edges thereof defining said central opening therebetween and extend coplanarly with respect to one another so as to provide a platform upon which to rest an ornament.

15. The device of claim 14 wherein said plurality of gripping elements define radial slots extending therebetween from said central opening outward to said interior side of said annular body to provide spaces between said gripping elements.

16. A hanger element for attachment to an elongated decoration, comprising:

(a) a pair of flaps;

(b) means for hinging said flaps to one another to undergo movement between open and closed positions; and (c) rib means for fastening said flaps to one another at said closed position and for clamping one end portion of an elongated decoration between said flaps at said closed position.

17. The hanger element of claim 16 further comprising:

(d) means for hanging said flaps to a support structure at said closed position to support the elongated decoration from the support structure.

18. The hanger element of claim 17 wherein said hanging means is a pair of apertures each defined in one of said flaps and being aligned with one another with said flaps at said closed position.

19. The hanger element of claim 16 wherein said means for hinging is a living hinge portion connected to said flaps along adjacent inner edges thereof so as to permit said flaps to fold away from and toward one another.

20. The hanger element of claim 16 wherein said means for fastening and clamping are complementary sets of ribs defined on said flaps and being spaced opposite one another and adjacent to opposite edge portions of said flaps, said sets of ribs being adapted to snap fit together upon moving said flaps to said closed position.

* * * * *